US005235878A

United States Patent [19]

Young

[11] Patent Number: 5,235,878

[45] Date of Patent: Aug. 17, 1993

[54] STUD GRIPPER SOCKET

[76] Inventor: Richard H. Young, 212 Andover Rd., Billerica, Mass. 01821

[21] Appl. No.: 905,121

[22] Filed: Jun. 23, 1992

Related U.S. Application Data

[63] Continuation of Ser. No. 550,651, Jul. 10, 1990, abandoned.

[51] Int. Cl.[5] ..... B25B 13/50

[52] U.S. Cl. ..... 81/53.2; 279/55; 192/44

[58] Field of Search ..... 81/53.2, 59.1; 279/1 TE, 30, 55, 58; 192/44, 45

[56] References Cited

U.S. PATENT DOCUMENTS 3,889,557 6/1975 Young ..... 81/53.2

4,611,513 9/1986 Young et al. ..... 81/53.2

*Primary Examiner*—James G. Smith

*Attorney, Agent, or Firm*—Iandiorio & Dingman

[57] ABSTRACT

A circumferential bead for preventing pin rollover is disposed on a retainer insert mounted in the shell of a stud gripper socket and spaced from the inner surface of the shell. The shell has at least one cam surface on its inner surface and there are roller pins disposed for rolling motion on each cam surface between the cam surface and the retainer insert. Each roller pin includes a circumferential retainer groove; the circumferential bead on the retainer insert engages the grooves on the pins; the bead has a curved contour associated with each cam surface for defining a gap which, intermediate the ends of the cam surface, is at least as wide as the pin diameter less the groove depth to permit the pin to freely roll along the associated cam surface, and which is less than the pin diameter to prevent the pin from falling out of of the shell, and which gap at the ends of the cam surface is narrower than the diameter of the pin less the depth of the groove to pinch the groove and prevent the pin from rolling beyond the ends of its associated cam surface.

7 Claims, 3 Drawing Sheets

STUD GRIPPER SOCKET

This is a continuation of application Ser. No. 07/550,651, filed Jul. 10, 1990, now abandoned.

FIELD OF INVENTION

This invention relates to an improved stud gripper socket which employs a contoured bead to eliminate pin rollover and more particularly to the use of a self-forming deformable bead which prevents pin rollover and secures the pin retainer insert in the socket shell.

BACKGROUND OF INVENTION

In stud gripper sockets such as disclosed in U.S. Pat. Nos. 4,611,513 and 3,889,557, incorporated herein by reference, the rolling pins are constrained to roll on their respective cam surfaces by a circumferential bead on a retaining insert, which bead engages with a circumferential groove on each pin. The bead permits each pin to rotate about its longitudinal axis but prevents it from moving in the direction of that axis and falling out of the socket. A problem occurs in such devices when under high torque one or more pins does not stop at rolling up its cam surface to the maximum bearinq point but goes beyond that point and slips into the next cam surface. This detracts from the gripping action and can damage or destroy the socket. A pin engages in such action when the pin retaining plastic insert collapses or partially collapses under high forces, thereby enlarging the gap between insert and cam surfaces sufficiently to allow a pin to slip through to the next cam surface. The insert is thus a critical point of the gripper socket: because it not only retains the pins against falling out but also creates the critical spacing which normally prevents the pins from rolling into the next cam surface. In order to insure that the gap between the insert and cam surface is maintained at the proper width, it is necessary to securely mount the insert in the shell of the socket so that it does not wobble or move from side to side pinching some pins while affording others a wider gap than desirable for preventing rollout of a pin into the neighboring cam surface.

SUMMARY OF INVENTION

It is therefore an object of this invention to provide an improved stud gripper socket which eliminates pin rollover into adjacent cam surfaces.

It is a further object of this invention to provide such an improved stud gripper socket which is simple in design, easy and inexpensive to manufacture, and is effective and reliable.

It is a further object of this invention to provide such an improved stud gripper socket in which the pin retaining bead also functions to prevent pin rollover into adjacent cam surfaces.

It is a further object of this invention to provide such an improved stud gripper socket in which the pin retaining bead is deformable and self-forming by operation of the socket to define a bead contour which prevents pin rollover.

It is a further object of this invention to provide such an improved stud gripper socket which securely mounts the insert in the socket shell and maintains the insert alignment with respect to the socket shell.

It is a further object of this invention to provide such an improved stud gripper socket in which the pin retaining bead also functions to secure the pin retainer insert in the shell of the socket.

It is a further object of this invention to provide such an improved stud gripper socket in which the retaining bead is deformable and self-forming to tightly engage the inner surface of the shell of the socket and secure the retainer insert in the socket.

The invention results from the realization that a truly sturdy, reliable stud gripper socket which eliminates pin rollover can be constructed by providing on the pin retainer insert a circumferential bead having a curved contour associated with each cam surface to define a gap which is large enough to permit free rolling of the pins but is narrow enough at the ends of each cam surface to pinch the pin and prevent its progress into an adjacent cam surface, and from the further realization that the necessary curved contours can be self-formed upon operation of the socket by using a deformable bead and further that that same deformable bead can be used to secure the retainer insert in the shell of the socket.

The invention features a stud gripper socket including a shell having at least one cam surface on its inner surface. A retainer insert is mounted in the shell spaced from the inner surface of the shell. A roller pin is disposed for rolling motion in each cam surface between the cam surface and the retainer insert. Each roller pin includes a circumferential retainer groove. A circumferential bead on the insert engages the grooves on the pins. The bead has a curved contour associated with each cam surface for defining a gap which, intermediate the ends of the cam surface, is at least as wide as the pin diameter less the groove depth in order to permit the pin to freely roll along the associated cam surface. The gap is less than the pin diameter in order to prevent the pin from falling out of the shell. At the ends of the cam surface the gap is narrower than the diameter of the pin less the depth of the groove in order to pinch the groove and prevent the pin from rolling beyond the ends of its associated cam surface.

In a broader sense, the invention features a circumferential bead on a retainer insert which is mounted in the shell of stud gripper socket and spaced from the inner surface of the shell. The shell includes at least one cam surface on its inner surface and there is a roller pin disposed for rolling motion in each cam surface between the cam surface and the retainer insert. Each roller pin includes a circumferential retainer groove. The bead engages the grooves on the pins. The bead has a curved contour associated with each cam surface for defining a gap which, intermediate the ends of the cam surface, is at least as wide as the pin diameter less the groove depth, in order to permit the pin to freely roll along the associated cam surface. The gap is less than the pin diameter in order to prevent the pin from falling out of the shell. The gap at the ends of the cam surface is narrower than the diameter of the pin less the depth of the groove in order to pinch the groove to prevent the pin from rolling beyond the ends of its associated cam surface.

The cam surface is generally concave and each associated curved contour on the bead is generally convex and similar in shape to the associated cam surface.

The invention also features a retainer insert for mounting in the shell of a stud gripper socket and spaced from the inner surface of the shell, which shell has at least one cam surface on the inner surface and a roller pin disposed for rolling motion on each cam surface between the cam surface and retainer insert. Each roller pin includes a circumferential retainer groove. The retainer insert includes a circumferential, partially deformable bead. The bead bas a thin outer periphery for deformably engaging the groove on each pin in order to enable the groove on each pin to deform the associated periphery of the bead during the initial motion of the pin along the cam surface to form a contour that defines a gap which, intermediate the end of the cam surface, is at least as wide as the pin diameter less the groove depth to permit the pin freely to roll along the associated cam surface. The gap is less than the pin diameter to prevent the pin from falling out of the shell. The bead has increased thickness between the thin outer periphery and the insert for limiting the deformability by an associated pin to define the gap at the ends of the cam surface more narrowly than the diameter of the pin less the depth of the groove in order to pinch the groove and prevent the pin from rolling beyond the ends of its associated cam surface into the next cam surface.

The invention also features a method of shaping a deformable bead on the retainer insert used in a shell of a stud gripper socket to define a gap for receiving at least one roller pin between the inner surface of the shell and the bead. In the socket the inner surface of the shell includes at least one cam surface and a roller pin associated with each cam surface. Each roller pin has a groove for engaging the bead. The method includes forming on the retainer insert a deformable bead having a thin deformable outer periphery and a thicker, non-deformable intermediate section; and installing the retainer insert in the shell of the stud gripper socket. A roller pin is installed at each cam surface in the gap between the shell and the bead. The stud gripper socket is applied to a stud and torqued to drive each roller pin circumferentially along its associated cam surface and radially inwardly to deform the deformable outer periphery of the bead and define a gap which enables the roller pin to roll along the cam surface. The intermediate section resists deformation and maintains a narrower gap between the bead portion and the ends of the cam surface to pinch the groove and prevent the pin from rolling beyond the ends of its associated cam surface into the next cam surface.

The invention also features a self-securing retainer insert for a stud gripper socket having a shell with an inner surface including at least one cam surface having ends which extend radially inwardly. There is a deformable bead circumferentially disposed on the retainer insert. The bead has a thin deformable outer periphery extending radially outwardly further than the radially inwardly extending ends of each cam surface for deformably engaging the ends of the cam surface and snugly securing the retainer in the shell.

DISCLOSURE OF PREFERRED EMBODIMENT

Other objects, features and advantages will occur to those skilled in the art from the following description of a preferred embodiment and the accompanying drawings, in which.

The invention may be accomplished in a stud gripper socket which has a shell which typically has a plurality of cam surfaces on its inner surface. There is a retainer insert mounted in the shell and spaced from the inner surface of the shell. A plurality of roller pins, one associated with each cam surface, is disposed for rolling motion on each cam surface between the cam surface and the retainer insert. Each roller pin has a circumferential retainer groove. There is a circumferential bead provided on the insert engaging those grooves on the pins. The bead has a curved contour associated with each of the cam surfaces for defining a gap which intermediate the end of the cam surface is at least as wide as the pin diameter less the groove depth in order to permit the pin to freely roll along the associated cam surface. The gap is less than the pin diameter in order to prevent the pin from falling out of the shell. The gap at the end of each cam surface is narrower than the diameter of the pin less the depth of the groove, in order to pinch the groove and prevent the pin from rolling beyond the ends of its associated cam surface. The retainer insert is typically metal or some other crush-resistant material. Each of the cam surfaces is typically concave and each of the associated curved contours on the bead is generally convex and similar in shape to the associated cam surface. The bead may be formed by die casting or some similar method.

In a less expensive approach, the bead may be formed with a thin outer edge that is readily deformable by the grooves on the roller pins when the socket is torqued in the normal way. This eliminates the need for die casting or other techniques for specifically forming the curved contours on the bead. In this approach the bead is self-formed by the deformation induced by the roller pin action when the socket is torqued. While the periphery of the bead is thin in order to promote deformability for this purpose the intermediate section of the bead is thicker to resist deformation in order to define a minimum gap width at the ends of each of the cam surfaces so that the pin cannot roll beyond that point from its own cam surface into the next.

The same deformable bead with the thinner peripheral area may also function to engage the inwardly extending junctions between the concave cam surfaces in order to securely mount the retainer insert in the shell of the socket.

Figure 1:
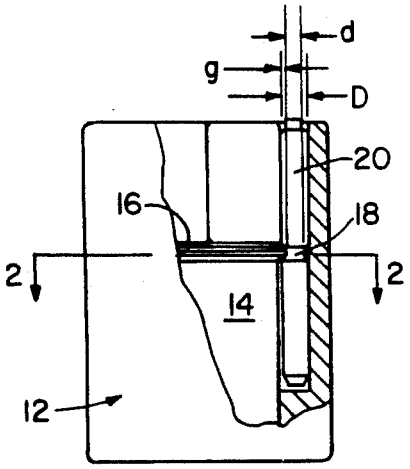
FIG. 1 is a side elevational view with portions broken away of an improved stud gripper socket according to this invention.

There is shown in FIG. 1 a stud gripper socket according to this invention which includes a shell 12 containing a retainer insert 14 having a circumferential bead 16 which engages with groove 18 in roller pin 20. Roller pin 20 has a diameter D, groove 18 has an inner diameter d, and the difference between the two is the groove depth g.

Figure 2:
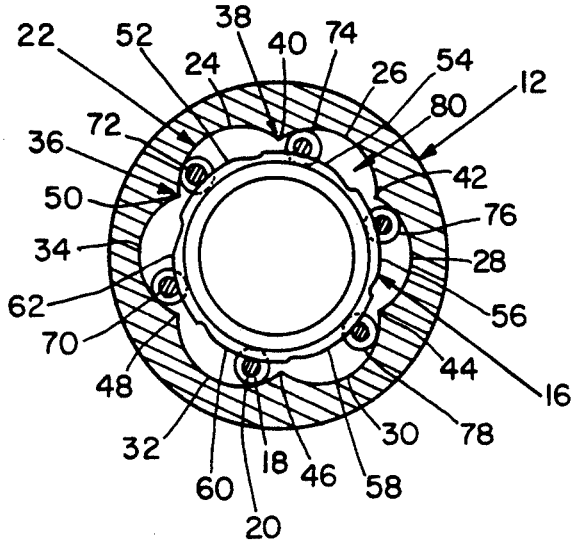
FIG. 2 is a cross-sectional view taken along lines 2—2 of FIG. 1.

Socket 12, FIG. 2, has an inner surface 22 which includes one or more cam surfaces 24, 26, 28, 30, 32, 34, which are generally arcuate in shape and concave facing inwardly. Each cam surface 24–34 has associated with it a pin 72, 74, 76, 78, 20 and 70, respectively. Each cam surface has two ends 36, 38 as shown with respect to cam surface 24. Each separate end surface 36, 38 of each cam surface meets the end surface of a neighboring cam surface to form radially inwardly extending junctions 40, 42, 44, 46, 48, 50. Bead 16 is formed with six curved contours 52, 54, 56, 58, 60 and 62, one associated with each of the cam surfaces 24–34.

Figure 3:
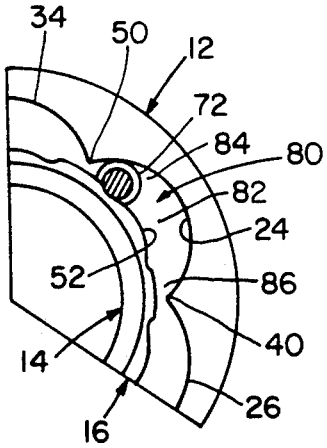
FIG. 3 is an enlarged detail view of a portion of the socket of FIG. 2.

These curved contours 52–62 are convex and are shaped generally similarly to the associated camming surface 24–34, in order to form a gap 80 (which is shown more clearly in the enlarged detail view of the area associated with curved contour 24, FIG. 3), which is at least as wide as the diameter D of the roller pin minus the depth g of the groove in the central area 82. In order to permit the roller pin 72 to freely roll along cam surface 24, central gap portion 82 is narrower than the width D of the roller pin to prevent the roller pin from falling out of socket 10.

At each end 84, 86, gap 80 narrows to a width less than the diameter D minus groove depth g in order to pinch pin 72 and prevent it from rolling over point or junction 50 into the next camming surface 34. With the outer surface of pin 72 the narrowing gap 84 causes the curved contour 52 bearing on the bottom of the groove to force pin 72 radially outwardly so that its outer surface jams against the end of camming surface 24 proximate junction 50.

Figure 4:
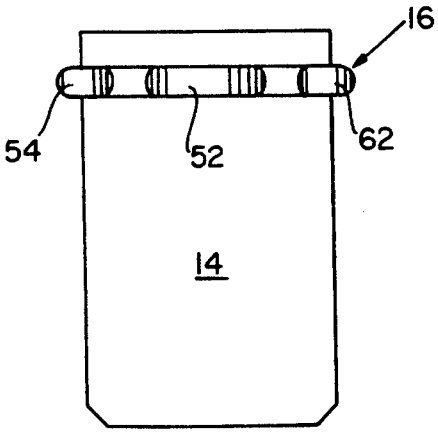
FIG. 4 is a side view of a retainer insert using the improved bead according to this invention.
Figure 5:
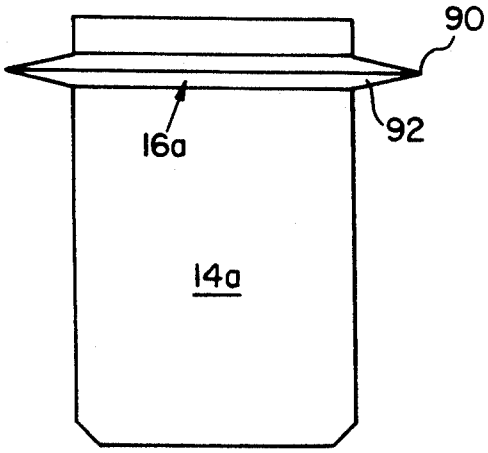
FIG. 5 is a view similar to FIG. 4 illustrating a deformable bead according to this invention.
Figure 6:
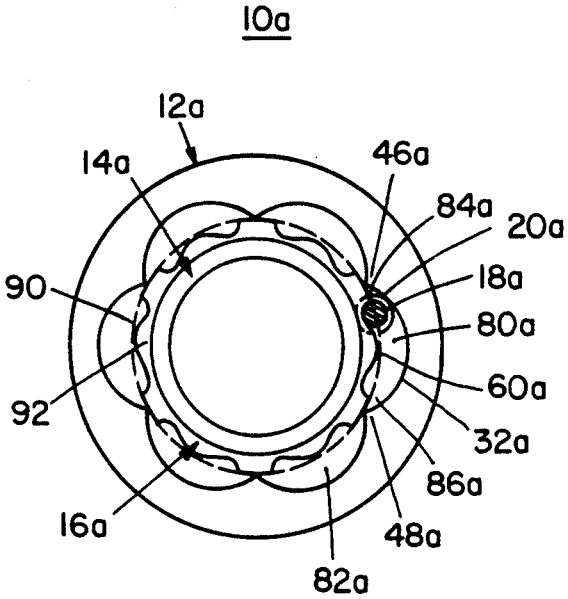
FIG. 6 is a top plan view of a socket using the retainer with the deformable bead of FIG. 5 after the bead has been self-formed by deforming by the roller pins as a result of torquing of the socket.

The configuration of the contours may be seen more readily in FIG. 4, where curved contours 54, 52 and 62 are shown. Instead of pre-forming curved contours on bead 16 by die casting or some similar technique, they may be self-formed by the action of the roller pins when the socket is torqued in normal use. In that instance, retainer insert 4*a*, FIG. 5, is formed with a bead 16*a*, that has a thin outer periphery 90 that is easily deformable, and a thicker intermediate section 92 that resists deformation. Retainer 4*a* is mounted in shell 12*a*, FIG. 6, of socket 10*a*. When socket 12*a* is then torqued in the normal fashion in both directions, force is applied through groove 20*a* of pin 18*a* (and the grooves of each of the other pins) and creates a curved contour 60*a* which is similar to the shape of camming surface 32*a*. Thus without any special techniques or machining, the curved contours create a gap 80*a* similar to gap 80 having a broad central portion 82*a* that allows free rolling of pin 18*a* and provides two narrower end portions 84*a* and 86*a*, which cause the pin to be trapped at point 46*a*.

Figure 7:
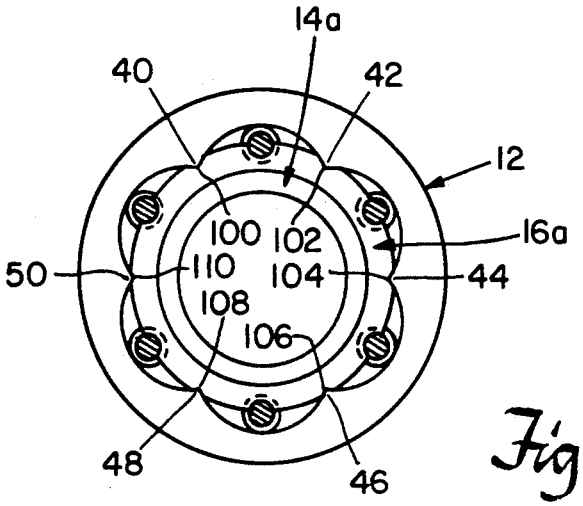
FIG. 7 is a top plan view similar to that shown in FIG. 2 illustrating the function of the deformable bead of FIG. 5 to secure the retainer insert in the shell.
Figure 8:
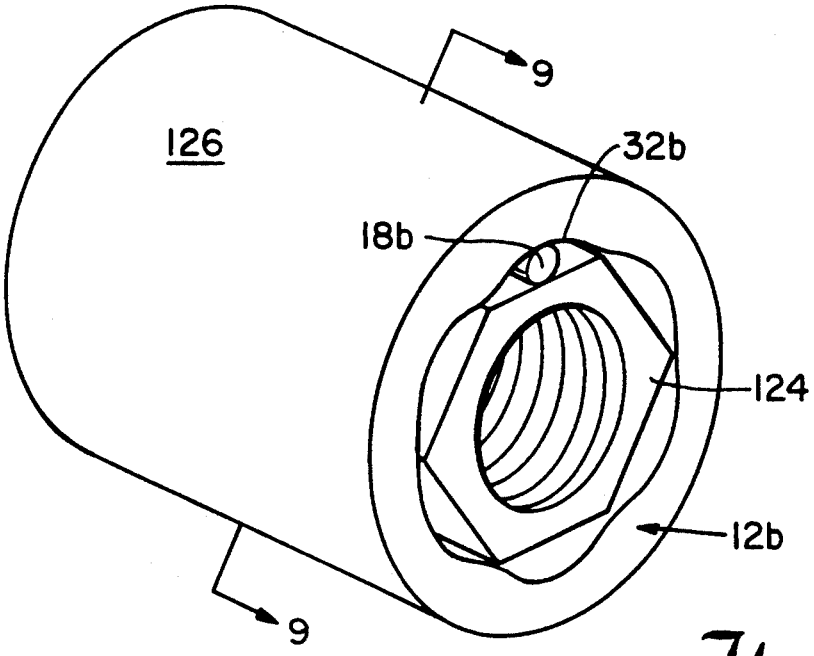
FIG. 8 is a plan view of another embodiment showing the use of a single roller.
Figure 9:
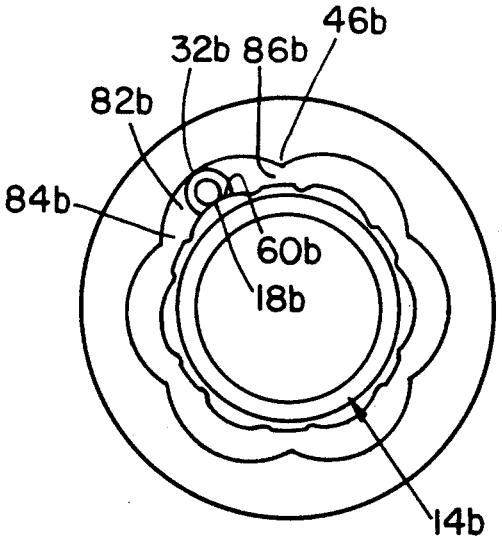
FIG. 9 is a cross sectional view taken along lines 9—9 of FIG. 8.

Bead 16*a* on retainer insert 14*a*, FIG. 5, performs a second function as shown in FIG. 7, where bead 16*a* extends radially outwardly beyond the inward radial extent of points or junctions 40, 42, 44, 46, 48 and 50, so that the outer edge of bead 16*a* is deformed, forming indents 100, 102, 104, 106, 108 and 110, which snugly engage junctions 40–50 and result in a tight fit between retainer insert 14*a* and shell 12 of socket 10. Depending on the specific application, the stud gripper socket shell 12*b* of this invention may have only one cam surface 32*b*, FIG. 8, and one pin 18b. In this embodiment, there is one pin 18b for gripping nut 124. Retainer 14b of socket shell 12b, FIG. 9, has one corresponding curved contour 60b which is similar to the shape of camming surface 32b. Broad central portion 82b allows free rolling of pin 18*b* and provides two narrow end portions 84*b* and 86*b* which cause the pin to be trapped at point 46b.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A stud gripper socket comprising:
   - a shell having at least one cam surface on its inner surface;
   - a retainer insert mounted in said shell and spaced from said inner surface of said shell;
   - a roller pin having a diameter D disposed for rolling motion in each said cam surface between said cam surface and said retainer insert, each said roller pin including a circumferential retainer groove;
   - a circumferential varying thickness bead on said insert for engaging said grooves on said pins, said bead having a curved contour associated with each said cam surface, said curved contour of said bead defining a gap which, intermediate the ends of each said cam surface, is at least as wide as pin diameter D less the groove depth to permit the pin to freely roll along its associated cam surface, said gap less than diameter D to prevent the pin from falling out of the shell, and which gap at the ends of each said cam surface is narrower than diameter D of said pin less the depth of the groove to pinch the groove and prevent said pin from rolling beyond the ends of its associated cam surface.

2. The stud gripper socket of claim 1 in which each said cam surface is generally concave and each said associated curved contour is generally convex and similar in shape to the associated cam surface.

3. A retainer insert for mounting in the shell of a stud gripper socket and spaced from the inner surface of the shell which has at least one cam surface on the inner surface and a roller pin disposed for rolling motion on each cam surface between the cam surface and retainer insert, each roller pin including a circumferential retainer groove, the retainer insert comprising:
   - a circumferential, partially deformable bead on said insert; said bead having a thin outer periphery for deformably engaging the groove on each pin for enabling the groove on each pin to deform, during at least the initial motion of the pin along the cam surface, the associated periphery of the bead to form a contour that defines a gap which, intermediate the ends of the cam surface, is at least as wide as the pin diameter less the groove depth to permit the pin freely to roll along the associated cam surface and is less than the pin diameter to prevent the pin from falling out of the a shell, said bead having increased thickness between the thin outer periphery and the insert for limiting deformability by an associated pin to define the gap at the ends of the cam surface narrower than the diameter of the pin less the depth of the groove to pinch the groove and prevent the pin from rolling beyond the ends of its associated cam surface.

4. A gripper socket comprising:
   - a shell having at least one cam surface on its inner surface, said cam surface having a broad central portion and two end portions;
   - a roller pin for one said cam surface disposed for rolling motion about said broad portion of said cam surface, said roller pin having a circumferential retainer groove; and a retainer insert mounted in said shell, spaced from said inner surface of said shell, and having a varying thickness circumferential bead for engaging with said groove of said pin, said bead having a curved contour, which for the portion of said curved contour opposite said broad portion of said cam surface, mirrors said broad portion of said cam surface, and which, for the portion of said curved contour opposite said end portions of said cam surface, defines a narrow gap for said space between said bead and said cam surface, said gap smaller than the diameter of said pin less the depth of said groove of said pin to pinch said pin as it rolls proximate said end portions of said cam surface thereby preventing it from escaping its associated cam surface.

5. A gripper socket comprising:

a shell having a plurality of cam surfaces on its inner surface, each said cam surface having a broad central portion and two end portions;

a plurality of roller pins, one for each said cam surface and each disposed for rolling motion about said broad portion of each said cam surface, each said roller pin having a circumferential retainer groove; and a retainer insert mounted in said shell, spaced from said inner surface of said shell, and having a varying thickness circumferential bead for engaging with said groove of said pins, said bead having a curved contour, which for the portion of said curved contour opposite said broad portion of each said cam surface, mirrors said broad portion of each said cam surface, and which, for the portion of said curved contour opposite said end portions of each said cam surface, defines a narrow gap for said space between said bead and each said cam surface, said gap smaller than the diameter of said pin less the depth of said groove of said pins to pinch said pins as they roll proximate said end portions of each said cam thereby preventing the pins from escaping their associated cam surfaces.

6. A stud gripper socket comprising:

A shell having a plurality of cam surfaces on its inner surface;

A retainer insert mounted in said shell and spaced from said inner surface of said shell;

A plurality of roller pins disposed for rolling motion in each said cam surface between said cam surface and said retainer insert, each said roller pin including a circumferential retainer groove;

A circumferential varying thickness bead on said insert for engaging said grooves on said pins, said bead having a curved contour associated with each said cam surface, said curved contour varying thickness bead defining a gap between said bead and ends of each said cam surface less than the depth of the circumferential retainer groove of each said pin to prevent each said pin from rolling beyond the ends of its associated cam surface.

7. A stud gripper socket comprising shell having at least one cam surface on its inner surface;

a retainer insert mounted in said shell and spaced from said inner surface of said shell;

a roller pin disposed for rolling motion in each said cam surface between said cam surface and said retainer insert, each said roller pin including a circumferential retainer groove;

a circumferential partially deformable bead on said insert, said bead having a thin outer periphery for deformably engaging the groove on each said pin for enabling the groove on each said pin to deform, during at least the initial motion of the pin along its associated cam surface, the associated periphery of the bead to form a varying thickness curved contour that defines a gap between the bead and the ends of each said cam surface less than the depth of the circumferential retainer groove of each said pin to prevent the pin from rolling beyond the ends of its associated cam surface.

* * * * *

UNITED STATES PATENT AND TRADEMARK OFFICE

CERTIFICATE OF CORRECTION

PATENT NO. : 5,235,878

DATED : August 17, 1993

INVENTOR(S) : Young

It is certified that error appears in the above-indentified patent and that said Letters Patent is hereby corrected as shown below:

On the title page: Item [76] Inventors: should read --Richard H. Young, Richard H. Young, II --.

Signed and Sealed this

Seventh Day of February, 1995

*Attest:*

Bruce Lehman

BRUCE LEHMAN

*Attesting Officer*

*Commissioner of Patents and Trademarks*